US006202327B1

(12) United States Patent
Fuller et al.

(10) Patent No.: US 6,202,327 B1
(45) Date of Patent: Mar. 20, 2001

(54) ICE SCRAPER HAVING NON-ROTARY TOOLS WITH SHIELDED CUTTING INSERTS

(75) Inventors: Gary A. Fuller, Abingdon, VA (US); Roland Thomas Disinger, Minneapolis, MN (US); Larry J. McSweeney, South Point, OH (US)

(73) Assignee: Eimco LLC, Bluefield, WV (US)

( * ) Notice: Subject to any disclaimer, the term of this patent is extended or adjusted under 35 U.S.C. 154(b) by 0 days.

(21) Appl. No.: 09/305,333

(22) Filed: May 5, 1999

(51) Int. Cl.[7] ..... E01H 4/00; E01H 5/04
(52) U.S. Cl. ..... 37/220; 37/219
(58) Field of Search ..... 37/196, 214, 219, 37/220, 221, 226, 228, 270, 460, 465; 172/777, 684.5, 713, 737, 747, 770

(56) References Cited

U.S. PATENT DOCUMENTS

| | | | | |
|---|---|---|---|---|
| 2,892,270 | * | 6/1959 | Sharp | 172/777 |
| 3,529,677 | * | 9/1970 | Stephenson | 37/460 X |
| 3,934,654 | * | 1/1976 | Stephenson et al. | 37/266 X |
| 4,140,888 | | 2/1979 | Baron et al. . | |
| 4,753,299 | | 6/1988 | Meyers . | |
| 4,784,517 | | 11/1988 | Bergqvist et al. . | |
| 4,883,129 | | 11/1989 | Lonn et al. . | |
| 5,054,217 | | 10/1991 | Nilsson et al. . | |
| 5,778,572 | * | 7/1998 | Lukavich et al. | 37/460 |
| 5,813,474 | * | 9/1998 | Manway | 37/460 X |

FOREIGN PATENT DOCUMENTS

| | | | | |
|---|---|---|---|---|
| 53-16209 | * | 2/1978 | (JP) | 37/214 |

* cited by examiner

*Primary Examiner*—Thomas B. Will
*Assistant Examiner*—Meredith C. Petravick
(74) *Attorney, Agent, or Firm*—Burns, Doane, Swecker & Mathis, LLP

(57) ABSTRACT

A vehicle-mounted ice-scraping mechanism includes a tool carrier mounted on the vehicle, and a plurality of non-rotatable ice-scraping tools mounted on the tool carrier and depending downwardly therefrom. Each tool includes a shank mounted to the tool carrier, and a cutting head depending downwardly from the shank. The cutting head is formed of a steel main body, and a carbide insert is mounted in the steel body at a location spaced from a front end of the steel body. During a wear-in period, front and bottom surfaces of the steel body define a rake face and a clearance face, respectively, of the tool. After the wear-in period, front and bottom surfaces of the insert define the rake face and clearance face, respectively. The tool is oriented such that the shank and the rake face extend upwardly and forwardly to define a positive rake angle. The tool shanks are cylindrical and are mounted in cylindrical bores in the tool carrier. The cutting heads are situated so closely together that they abut one another and thereby prevent rotation of the tools relative to the tool carrier.

28 Claims, 3 Drawing Sheets

FIG. 2
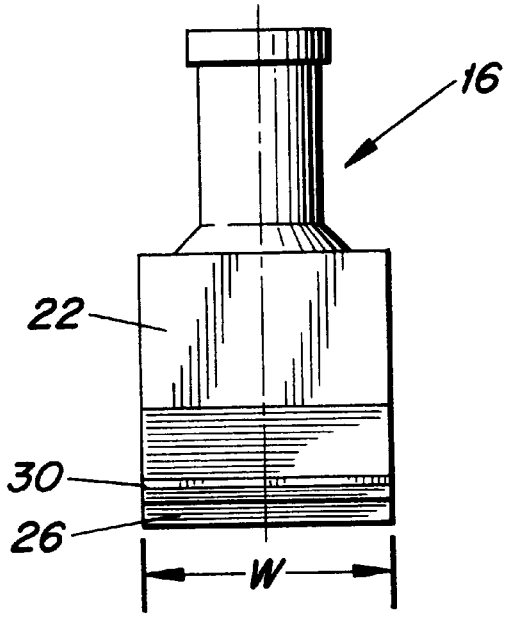
FIG. 3
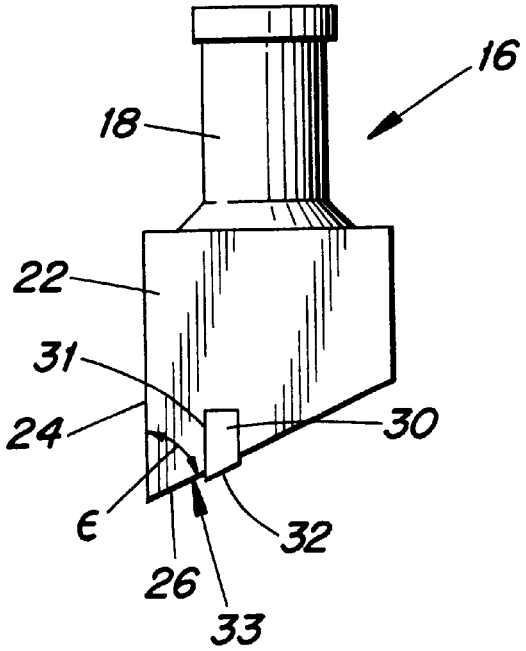
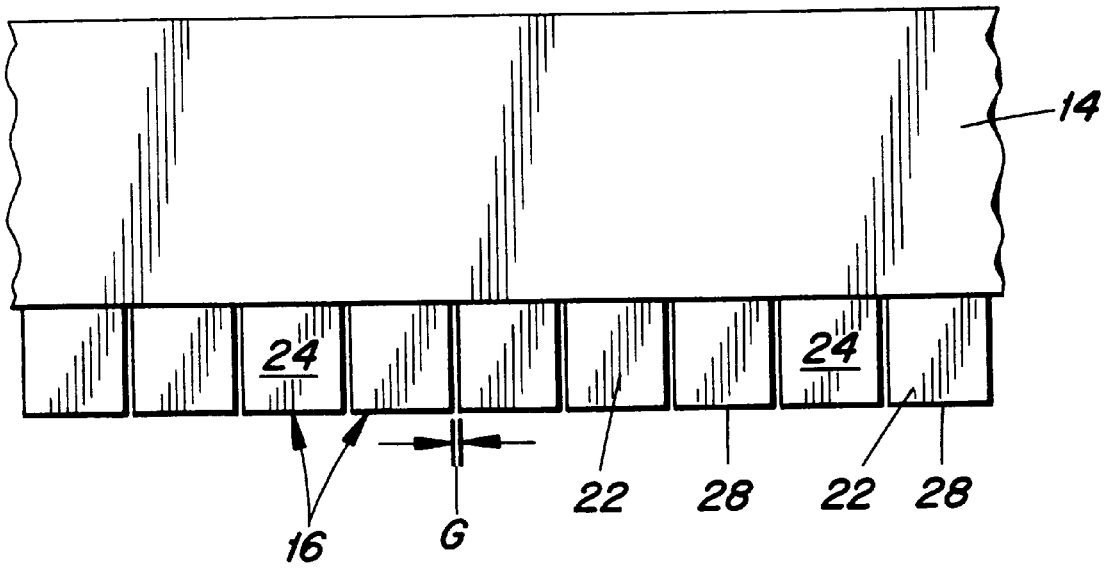
FIG. 4

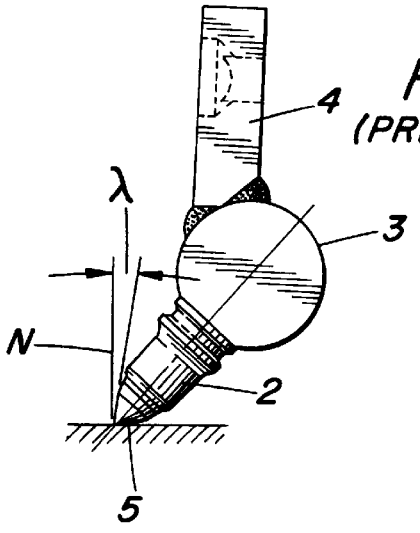
FIG. 5
(PRIOR ART)
FIG. 6
(PRIOR ART)
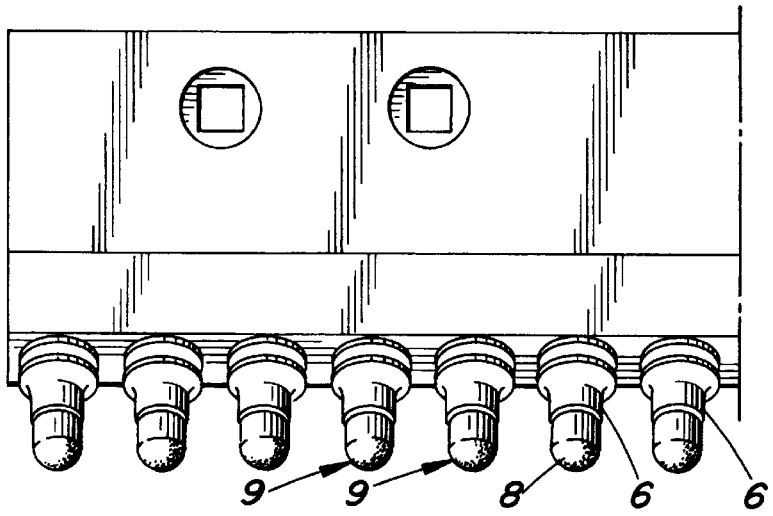
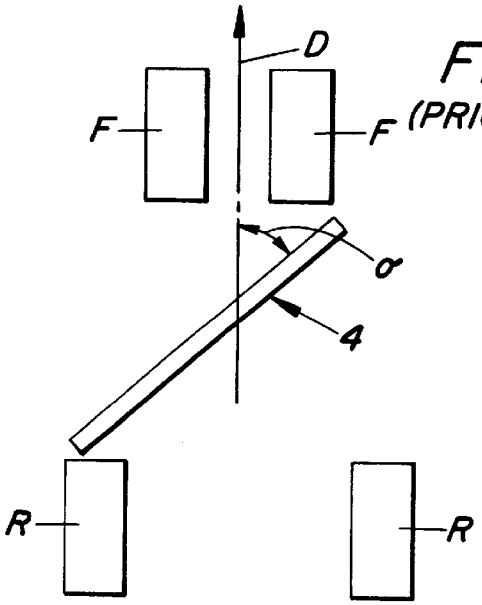
FIG. 8
(PRIOR ART)
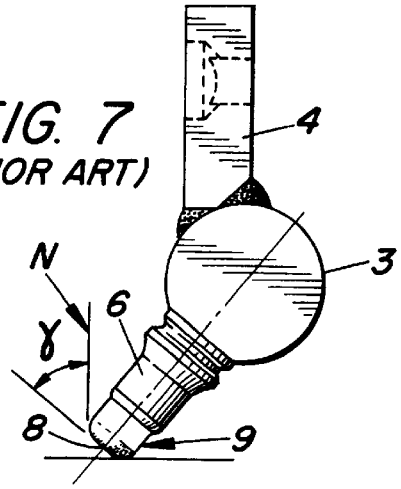
FIG. 7
(PRIOR ART)

ICE SCRAPER HAVING NON-ROTARY TOOLS WITH SHIELDED CUTTING INSERTS

BACKGROUND OF THE INVENTION

The present invention relates to ice scraping tools or bits of the type mounted on ice/snow removal vehicles, and to an ice-cutting method.

It is common to utilize vehicles to scrape ice from roadways by means of tools mounted on the vehicles. As depicted in FIG. 5, it is conventional to employ pointed tools 2 rotatably mounted in a carrier 3 that is welded on a vehicle-mounted board or blade 4, e.g., the board may be situated between the front and rear wheels F, W of the vehicle (see FIG. 8). The tools 2 project forwardly and downwardly at such an inclination that a hard pointed cutting tip 5 of the tool (e.g., a carbide tip) cuts at a negative rake angle A with reference to a normal N to the road surface (see Bergqvist et al. U.S. Pat. No. 4,784,517). Although such tools have been successfully used, they may, due to the negative characteristic of the rake angle, tend to pull themselves downwardly into the ice (i.e., they tend to be self-feeding) which can result in damage to the road surface beneath the ice.

As depicted in FIGS. 6 and 7, it has also been proposed to employ rotatable ice-scraping tools 6 each having a blunt circular scraping surface 8 which scrapes at a positive rake angle δ. While avoiding the self-feeding problem discussed above with reference to FIG. 5, such tools exhibit various shortcomings which are also characteristic of the FIG. 5 tool. A first of those shortcomings involves the fact that the tool shanks are inclined in an upward and rearward direction, whereby the tools tend not to ride over obstructions such as road unevenness, but rather tend to plow through the obstructions, causing damage to the tools and/or the road.

A second shortcoming stems from the fact that the hard cutting tips 9 of such tools are typically spaced apart in a direction transverse to the direction of vehicle travel D (see FIG. 6) and thereby cut spaced-apart grooves in the ice. The grooves serve an important function when used in conjunction with vehicles that disperse highway salt, because the grooves retain the salt, sheltering the salt against air currents caused by wind or passing traffic which could otherwise blow the salt off the ice. However, the salt deposited onto the areas of the ice surface situated between the grooves will not be sheltered and instead will be susceptible to being blown away.

A third shortcoming results from the use of cutting tips formed of a hard wear-resistant material, such as carbide (e.g., see also Meyers U.S. Pat. No. 4,753,299 disclosing carbide inserts on earth-working tools). A forwardly facing surface of the carbide insert is typically exposed and, due to the brittleness of the carbide material, is susceptible to being chipped in response to striking obstacles or uneven parts of the road surface.

It would be desirable to minimize or obviate problems of the above-described type.

For instance, it would be desirable to provide an ice-cutting tool which resists self-feeding, minimizes a tendency for deposited salt or sand to be blown from an ice surface, and exhibits a long life with minimal tendency for hard cutting tips to become chipped.

It would also be desirable to prove an ice-cutting mechanism and method in which the cutting tools tend to ride over obstructions such as road unevenness.

It would further be desirable to minimize the downward pressure needed to be applied to the ice-cutting tools.

SUMMARY OF THE INVENTION

One aspect of the present invention relates to a vehicle which includes an ice-scraping mechanism adapted to scrape ice from a roadway as the vehicle travels in a forward direction. The ice-scraping mechanism comprises a tool carrier mounted on the vehicle, and a plurality of ice-scraping tools mounted on the tool carrier and depending downwardly therefrom. Each tool is non-rotatable relative to the tool carrier and includes a shank mounting the tool to the tool carrier, and a cutting head depending downwardly from the shank. The cutting head includes a forwardly facing rake face having a cutting edge extending along a lower end thereof. The rake face extends upwardly from the cutting edge in a forwardly inclined direction to define a positive rake angle. The cutting edges of adjacent tools extend in a direction transversely of the forward direction of travel. The cutting edges are aligned in the transverse direction and are spaced apart by a distance less than a width of each cutting edge measured in the transverse direction.

The invention also pertains to an ice-scraping tool which comprises a shank adapted to mount the tool in a carrier, and a cutting head disposed at a lower end of the shank. The cutting head includes a rake face, a cutting edge extending along a lower end of the rake face, and a clearance face extending from the cutting edge in a direction extending away from the rake face and inclined upwardly toward the shank. The cutting head is formed by a main body and a hard insert mounted in the main body. The main body includes a forwardly facing front surface and a bottom surface extending rearwardly therefrom. The insert includes a forwardly facing front surface oriented parallel to, and spaced from, the front surface of the main body. The insert also includes a bottom surface extending rearwardly from the front surface of the insert. The insert is formed of a harder material than that of the main body. The main body is wearable relative to the insert during a wear-in period, whereby the front and bottom surfaces of the main body initially form the rake face and clearance face, respectively of the tool, and after the wear-in period the front and bottom surfaces of the insert form the rake face and the clearance face, respectively.

A further aspect of the invention relates to the fact that the tool shanks as well as the tool rake faces are inclined upwardly and forwardly to further tend to cause the tools to ride up and over obstructions.

Another aspect of the invention relates to an ice-scraping mechanism adapted to be mounted on a vehicle to scrape ice as the vehicle travels in a forward direction. The ice-scraping mechanism comprises a board having a plurality of cylindrical bores arranged in a line, and a plurality of ice-scraping tools mounted on the board. Each tool includes a cylindrical shank mounted in a respective one of the bores and defining an axis. Each tool further includes a cutting head rigid with the shank and disposed beneath the board. The cutting heads are arranged side-by-side so closely together that abutment of adjacent heads against one another constitutes a sole means of restraining the tools against rotation about the shank axes.

Yet another aspect of the invention relates to the cutting of ice wherein the tool shanks and tool rake faces are inclined forwardly and upwardly, whereby the tools tend to ride up and over obstructions.

BRIEF DESCRIPTION OF THE DRAWINGS

The objects and advantages of the invention will become apparent from the following detailed description of a preferred embodiment thereof in connection with the accompanying drawings in which like numerals designate like elements and in which:

FIG. 2 is a rear elevational view of an ice-scraping tool according to the present invention;

FIG. 3 is a side elevational view of the tool depicted in FIG. 2;

FIG. 4 is a front elevational view of the ice-scraping mechanism depicted in FIG. 1;

FIG. 5 is a side elevational view of a prior art ice-scraping mechanism;

FIG. 6 is a front view of an ice scraping mechanism utilizing another type of prior art tool;

FIG. 7 is a side elevational view of the mechanism depicted in FIG. 6.; and FIG. 8 is a schematic plan view depicting the conventional relationship between a tool carrier and the wheels of a vehicle.

DETAILED DESCRIPTION OF A PREFERRED EMBODIMENT OF THE INVENTION

Figure 1:
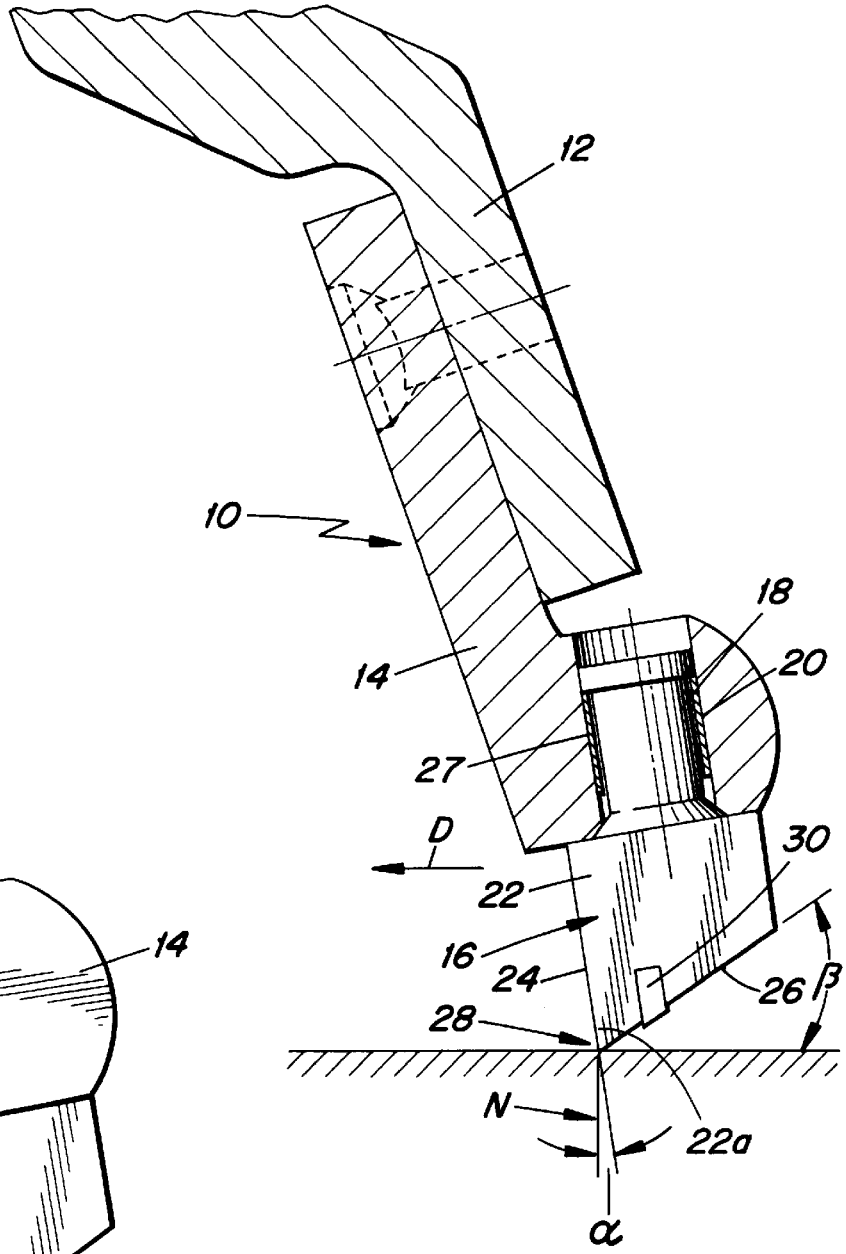
FIG. 1 is a vertical cross sectional view taken through an ice-scraping mechanism during a scraping operation, according to the present invention.

Depicted in FIG. 1 is an ice-scraping mechanism 10 adapted to be mounted on a vehicle such as a dump truck or a grader-type vehicle. The ice-scraping mechanism includes a board or blade 14 and a plurality of ice-scraping tools or bits 16 depending downwardly therefrom. The mechanism is shown in FIG. 1 as mounted on a vertically movable part 12 of a vehicle. The board 14 is inclined upwardly and forwardly, e.g., at an acute angle of about 20° relative to a vertical plane.

Each ice-scraping tool 16 includes a cylindrical shank 18 adapted to be removably mounted in a cylindrical hole 20 of the board 14, and a cutting head 22 integral with the shank. The shank is inclined upwardly and forwardly, e.g. at an angle of from 1° to 10° relative to a vertical plane. The cutting head 16 includes a front surface 24, and a bottom surface 26 which intersects the front surface 24 to form a straight cutting edge 28 therewith.

The front and bottom surfaces form between one another an acute angle $\epsilon$ preferably, but not necessarily, being about 65 degrees (see FIG. 3).

Mounted in the main body 22 is a hard insert 30 formed of a material harder than that from which the main body is formed. For example, the main body could be formed of steel, and the insert 30 formed of a cemented carbide such as tungsten carbide (WC) in a matrix of a binder such as cobalt (Co). The insert includes a front surface 31 oriented parallel to the front surface 24 of the main body, and a bottom surface 32 oriented parallel to the bottom surface 26 of the cutting head. An intersection of those two surfaces forms a straight cutting edge 33 of the insert.

The insert 30 is spaced rearwardly from the front surface 24 and preferably, but not necessarily, projects slightly downwardly beyond a plane of the bottom surface 26. A width W of the insert in a transverse direction, i.e., transverse to the direction of travel D, corresponds to a width of the cutting head 22 (FIG. 2). By "transverse" is meant a direction forming with the direction of travel D an angle $\sigma$ greater than zero and less than 180 degrees (see FIG. 8).

The shanks 18 are cylindrical, and the holes 20 are cylindrical. Each of the shanks is mounted within a respective hole 20 by means of a conventional elastic split sleeve 27 which is compressible to enable the tool to be inserted into the hole 20. Then, the sleeve applies a radial outward force against a surface of the hole 20 to frictionally the shank in the hole. Alternatively, other types of conventional sleeves could be employed, e.g., a sleeve which has radially outward projections arranged to abut an upwardly facing shoulder formed in the wall of the bore 18.

In order to prevent the tools from rotating about the shank axis, the tools are mounted such that the cutting heads are situated very closely together in side-by-side relationship. That is, the tools are, mounted such that their cutting edges 28 are mutually aligned in the transverse direction, and the cutting heads are in virtually-touching relationship, whereby the tools are unable to rotate about the respective shank axes. Preferably, the gap G between adjacent cutting edges is no more than 0.010 inches. Thus, the tools collectively cut a relatively wide swath through the ice, rather than cutting widely spaced grooves.

With the shanks 18 mounted in the holes 20, the front surfaces 24 of the main bodies are inclined downwardly and rearwardly (i.e., upwardly and forwardly). That is, the front surface 24 of each main body constitutes a rake face which forms with the ice an angle defined herein as a positive rake angle  in the range preferably of from 1° to 10°. Also, the bottom surface 26 of the main body constitutes a rake face forming with the rake face 24 a clearance angle $\beta$ in the range preferably of from 26° to 35°. As will be explained, however, eventually the rake face and clearance face become formed by the insert 30, after a wear-in period occurs.

In operation, the tools are mounted as shown in FIG. 1 wherein the lower edge of the front surface 24 of the main body functions as a cutting edge of the tool, and the front surface 24 of the main body functions as a rake face of the tool. That rake face 24 forms the positive rake angle . As a result, the tools 16 tend to be dragged across the ice surface, rather than to dig into the surface. Any tendency for the tools to dig down into the ice (i.e., to be self-feeding) is prevented. Achievement of this behavior is further aided by the fact that the shanks 18 themselves are inclined upwardly and forwardly, whereby forces transmitted from the cutting heads 22 to the shanks tend to cause the shanks to rise up and pass over obstructions.

Also, in the event that the tool were to strike an obstruction in the roadway (e.g., such as an unevenness in the road surface), the shock load applied to the tool will be minimized, due to the positive angle of the front surface 24, because such a positive angle tends to cause the tool to ride over, rather than dig into, the obstruction.

Eventually, after a wear-in period, a portion 16*a* of the steel main body of the cutting head 16 will wear to such an extent that the lower front edge of the insert 30 is exposed (FIG. 1 A), and will now define the cutting edge of the tool. Also, a lower portion of the front surface 31 of the insert will be exposed and define a rake face of the tool. The bottom surface 32 of the insert will then define the clearance face of the tool. Since the front and bottom faces of the insert are parallel to the front and bottom faces, respectively, of the main body, the cutting action will not be materially changed, except that the life of the cutting edge will be extended since the cutting edge of the carbide is now formed of a very hard substance, i.e., carbide.

Figure 1A:
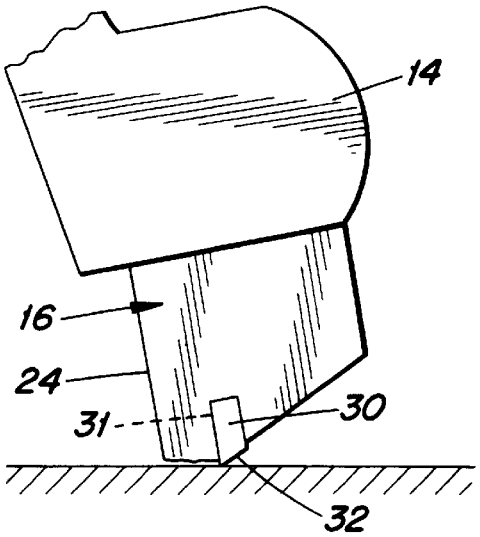
FIG. 1A is a fragmentary side elevational view of the ice-scraping mechanism according to FIG. 1 after a wear-in period has occurred.

Even if the insert had not initially extended downwardly beyond the bottom surface 26 of the main body, the arrangement shown in FIG. 1A would eventually have been attained due to the wearing of the main body.

Most of the front surface 31 of the insert 30 is shielded by the main body even after the wear-in period (see FIG. 1A), so that front surface will not be prematurely chipped away when obstructions are struck.

It will be appreciated that the positive rake angle afforded by the tools according to the invention avoids the self-feeding problem previously discussed.

By providing hard inserts that are spaced from the front surface of the softer main body, the life of the tool is increased without concern that the front surface of the insert will be prematurely chipped away.

Since the cutting edges are straight, transversely aligned, and disposed very close together, the tools collectively cut a wide swath in the ice (rather than a series of narrow, widely-spaced grooves), so the ice is better able to retain road salt or sand that may be dispersed thereon.

The relatively large clearance angle of 26°–35° provides ample space in which the ice cuttings can be discharged (scattered), rather than accumulating behind the cutting edge and being compressed between the roadway and the clearance face. In that regard, it is particularly useful to employ the tools 16 on a dump truck which also carries a front-mounted bulldozer blade and a rear sand/salt dispenser. The board 14 would be mounted beneath the truck body between the front and rear ends of the truck. It will be appreciated that the greater the downward pressure applied to the board, the less the traction on the truck wheels. Thus, by reducing the downward pressure that has to be applied to the board 14, more wheel traction will be available.

By mounting the tools 16 in cylindrical bores of a board 14, it is possible to remove the tools, and reuse the board to carry tools that are rotatable about their respective axes for cutting earth, asphalt, etc., as disclosed in Baron et al. U.S. Pat. No. 4,140,888. Thus, even though the tools 16 have cylindrical shanks mounted in cylindrical bores, they are restrained from rotation by the close positioning of adjacent tools.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A vehicle including an ice-scraping mechanism adapted to scrape ice from a roadway as the vehicle travels in a forward direction, the ice-scraping mechanism comprising:

a tool carrier mounted on the vehicle; and a plurality of ice-scraping tools mounted on the tool carrier and depending downwardly therefrom, each tool being non-rotatable relative to the tool carrier and including:

a shank mounting the tool to the tool carrier, and a cutting head depending downwardly from the shank and including a forwardly facing rake face having a cutting edge extending along a lower end thereof, the rake face extending upwardly from the cutting edge in a forwardly inclined direction to define a positive rake angle;

the cutting edges of adjacent tools extending in a direction transversely of the forward direction of travel, the cutting edges being aligned in the transverse direction and being spaced apart by a distance less than a width of each cutting edge measured in the transverse direction.

2. The vehicle according to claim 1 wherein the cutting head includes a clearance face extending rearwardly from the cutting edge at an upward inclination from horizontal in the range of 26 to 35°.

3. The vehicle according to claim 2 wherein an angle formed between the rake face and the clearance face is about 65°.

4. The vehicle according to claim 1 wherein the cutting head is formed by a main body and a hard insert mounted in the main body at a location rearwardly of a forwardly facing front surface of the main body, the insert formed of a material harder than that of the main body whereby during initial use of the tool the forwardly facing front surface of the main body defines the rake face, and a lower edge thereof forms the cutting edge, and after a wear-in period, a forwardly facing front surface of the insert defines the rake face and a lower edge thereof forms the cutting edge.

5. The vehicle according to claim 4 wherein the positive rake angle is in the range of 1° to 10°.

6. The vehicle according to claim 4 wherein the forwardly facing front surfaces of the main body and the insert, respectively, are parallel to one another.

7. The vehicle according to claim 4 wherein the main body is formed of steel, and the insert is formed of carbide.

8. The vehicle according to claim 4 wherein the main body includes a bottom surface defining a clearance face extending rearwardly from the cutting edge at an upward inclination from horizontal, the insert projecting downwardly past a plane of the bottom surface of the main body.

9. The vehicle according to claim 1 wherein the positive rake angle is in the range of 1° to 10°.

10. The vehicle according to claim 1 wherein the carrier includes cylindrical bores, the shanks being cylindrical and mounted in respective ones of the bores, the cutting heads being arranged in close side-by-side relationship whereby contact between adjacently disposed cutting heads constitutes a sole means of preventing rotation of the tools about axes of the shanks.

11. The vehicle according to claim 10 wherein the adjacent ones of the cutting edges are spaced apart by a maximum distance of about 0.010 inches.

12. The vehicle according to claim 1 wherein the shank is inclined in an upward and forward direction.

13. A vehicle including an ice-scraping mechanism adapted to scrape ice from a roadway as the vehicle travels in a forward direction, the ice-scraping mechanism comprising:

a tool carrier mounted on the vehicle; and a plurality of ice-scraping tools mounted on the tool carrier and depending downwardly therefrom, each tool being non-rotatable relative to the tool carrier and including:

a shank mounting the tool to the tool carrier, the shank being inclined in an upward and forward direction, and a cutting head depending downwardly from the shank and including a forwardly facing rake face having a cutting edge extending along a lower end thereof, the rake face inclined upwardly and forwardly from the cutting edge to define a positive rake angle.

14. The vehicle according to claim 13 wherein the tool carrier comprises a board inclined in an upward and forward direction.

15. The vehicle according to claim 13 wherein the cutting edges are linear and extend transversely relative to the direction of travel.

16. The vehicle according to claim 3 wherein the cutting head is formed by a main body and a hard insert mounted in the main body at a location rearwardly of a forwardly facing front surface of the main body, the insert formed of a material harder than that of the main body whereby during initial use of the tool the forwardly facing front surface of the main body defines the rake face, and a lower edge thereof forms the cutting edge, and after a wear-in period, a forwardly facing front surface of the insert defines the rake face and a lower edge thereof forms the cutting edge.

17. An ice-scraping tool comprising:

a shank adapted to mount the tool in a carrier and defining a longitudinal axis; and a cutting head disposed at a lower end of the shank, the cutting head including a rake face, a cutting edge extending along a lower end of the rake face, and a clearance face extending from the cutting edge in a direction extending away from the rake face and inclined upwardly toward the shank, the cutting head formed by a main body and a hard insert mounted in the main body;

the main body including a forwardly facing front surface defining the rake face and a bottom surface extending rearwardly therefrom and defining the clearance face, the insert including a forwardly facing front surface oriented parallel to, and spaced from, the front surface of the main body, the insert further including a bottom surface extending rearwardly from the front surface of the insert, the insert formed of a harder material than that of the main body to be more wear resistant than the main body;

a portion of the main body situated in front of the insert and extending farther downwardly than the insert, and such portion of the main body being wearable relative to the insert during an initial wear-in period of the tool, whereby the front and bottom surfaces of the main body initially form the rake face and clearance face, respectively, of the tool, and after the wear-in period the front and bottom surfaces of the insert form the rake face and the clearance face, respectively.

18. The ice-scraping tool according to claim 17 wherein the main body is formed of steel, and the insert is formed of carbide.

19. The ice scraping tool according to claim 18 wherein the shank has a cylindrical outer surface.

20. The ice scraping tool according to claim 18 wherein the insert projects downwardly farther than a plane of the bottom surface of the main face.

21. An ice-scraping mechanism adapted to be mounted on a vehicle to scrape ice as the vehicle travels in a forward direction, the ice-scraping mechanism comprising:

a board having a plurality of cylindrical bores arranged in a line; and a plurality of ice-scraping tools mounted on the board, each tool including a cylindrical shank mounted in a respective one of the bores and defining an axis, and a cutting head rigid with the shank and disposed beneath the board, the cutting heads being arranged side-by-side so closely together that abutment of adjacent heads against one another constitutes a sole means of restraining the tools against rotation about the shank axes.

22. The ice-scraping mechanism according to claim 21 wherein each tool forms a cutting edge extending in a direction transversely of a forward travel direction, the cutting edges being aligned in the transverse direction.

23. The ice-scraping mechanism according to claim 21 wherein each cutting head includes main body having a front rake face, and a clearance face extending rearwardly from a lower end of the rake face to form therewith a cutting edge, the tool further including a hard insert mounted in the body at a location spaced rearwardly from the front rake face, the insert formed of a material harder than the main body.

24. The ice-scraping mechanism according to claim 13 wherein the main body is formed of steel, and the hard insert is formed of carbide.

25. The ice-scraping tool according to claim 21 wherein a gap between adjacent cutting edges is no greater than about 0.010 inches.

26. A method of cutting ice in a roadway, the method utilizing a vehicle having a tool carrier mounted thereon, and a plurality of ice scraping tools mounted on the tool carrier and depending downwardly therefrom, each tool including a shank mounted in the tool carrier and a cutting head depending downwardly from the shank, the cutting head including a forwardly facing rake face having a cutting edge extending along a lower edge thereof, the method comprising the steps of:

A) advancing the vehicle in a direction of travel such that the shanks and the rake faces are inclined upwardly and forwardly with the cutting edges contacting the ice, whereby the tools tend to ride over obstructions, and B) preventing the tools from rotating about respective axes of the shanks.

27. The method according to claim 26 wherein the cutting head includes a main body and a hard insert mounted in the main body at a location rearwardly of a forwardly facing front surface of the main body, the insert formed of a material harder than that of the main body, the method further comprising initially causing the ice to be contacted by the main body and not by the insert, whereby the forwardly facing front surface of the main body defines the rake face and a lower edge of the main body defines the cutting edge, and subsequent to a wear-in period, the main body wears to cause a forwardly facing front surface of the insert to define the rake face and a lower edge of the insert to define the cutting edge.

28. The method according to claim 26 wherein step B is performed by positioning adjacent ones of the tools so closely together that the prevention of rotation is produced solely by contact between the adjacent tools.

* * * * *